United States Patent [19]

Vecchiarelli

[11] Patent Number: 4,552,196

[45] Date of Patent: Nov. 12, 1985

[54] VENETIAN BLIND ASSEMBLY INCLUDING TENSION MEANS FOR IMPARTING TENSION INTO SLAT SUPPORTING MEANS

[75] Inventor: Francis Vecchiarelli, River Edge, N.J.

[73] Assignee: Hunter Douglas International N.V., Curacao, Netherlands Antilles

[21] Appl. No.: 559,367

[22] Filed: Dec. 8, 1983

Related U.S. Application Data

[63] Continuation-in-part of Ser. No. 386,286, Jun. 8, 1982, abandoned.

[51] Int. Cl.[4] ..... E06B 9/28; E06B 9/307

[52] U.S. Cl. ..... 160/174

[58] Field of Search ..... 160/166 R, 168, 174, 160/178 E, 178 F, 166, 172, 173, 176

[56] References Cited

U.S. PATENT DOCUMENTS

| | | | |
|---|---|---|---|
| 1,690,644 | 11/1928 | Lennox | 160/172 |
| 1,962,730 | 6/1934 | Boyd | 160/172 |
| 3,265,117 | 8/1966 | Lorentzen et al. | 160/174 |

FOREIGN PATENT DOCUMENTS

| | | | |
|---|---|---|---|
| 1251507 | 10/1967 | Fed. Rep. of Germany | 160/166 R |

*Primary Examiner*—Peter M. Caun
*Assistant Examiner*—Cherney S. Lieberman
*Attorney, Agent, or Firm*—Pennie & Edmonds

[57] ABSTRACT

A venetian blind assembly having a plurality of slats supported by two slat support means. The assembly is adapted to be connected at opposite ends extending parallel to the slats to fixed frame members. Each slat support means includes a longitudinal side member having means to support the slats. Resilient means are provided for imparting tension into all of the longitudinal side members during tilting of the slats whereby the blind assembly may be oriented in a number of different positions including inclined and horizontal positions without sagging.

19 Claims, 10 Drawing Figures

Alternating Tension

Constant Tension

Constant Tension

Constant Tension

Constant Tension

VENETIAN BLIND ASSEMBLY INCLUDING TENSION MEANS FOR IMPARTING TENSION INTO SLAT SUPPORTING MEANS

CROSS-REFERENCE TO OTHER APPLICATIONS

This is a continuation-in-part of my copending U.S. patent application Ser. No. 06/386,286, filed June 8, 1982, now abandoned.

TECHNICAL FIELD

This invention relates to a venetian blind assembly having a plurality of slats and slat support means for individually supporting the slats, where the slat support means include longitudinal side members which are maintained under tension at least during the tilting of the slats.

BACKGROUND OF THE INVENTION

Venetian blind assemblies constructed for use with skylights, where the venetian blind assembly extends in a horizontal direction or where the blind assembly is to be inclined, usually have complicated cable arrangements stretched across an opening into which the blind assembly fits in order to support the assemblage of slats and prevent sagging. Such constructions are usually expensive and complicated to install.

Other blind assembly constructions for use with skylights involve mounting individual slats in holding devices which can be rotated or tilted together from one location. These constructions also usually involve expensive and complicated installations.

In conventional venetian blind assembly constructions, individual slats are often held together as an assemblage by ladder tapes, which usually comprise parallel cables spaced a slat width apart and connected by cross ladders or rungs. In some instances the cables are secured at their lower ends by a bottom rail which is connected to a fixed bottom frame member of an opening. This arrangement, however, is not adaptable for use with inclined venetian blind assemblies or skylight assemblies which extend in a horizontal direction, since the cables are usually slack and incapable of preventing the slats of the assembly from sagging.

It is therefore an object of my invention to provide for a venetian blind assembly which is readily adaptable for use with skylights or in inclined openings, as well as in venetian blind arrangements where the slats extend perpendicularly rather than horizontally as in the conventional blind constructions, and which when mounted is properly held in position and operable by way of a simple, easily mountable and operable arrangement.

It is a further object of the invention to provide for a venetian blind assembly which may be conveniently moved across a skylight or inclined opening in order to provide convenient cleaning of the skylight or pane covering an inclined opening.

GENERAL DESCRIPTION OF THE INVENTION

Broadly, a venetian blind assembly constructed according to my invention includes a plurality of slats and at least two slat support means for individually tiltably supporting the slats, where each slat support means has two longitudinal side members including means to support the slats. The assembly of slats is adapted to be connected at opposite sides to fixed end frame members extending parallel to the slats and forming part of an opening. Slat tilt means are provided to which one end of the longitudinal side members are connected. The invention includes having a resilient means for imparting tension in all of the longitudinal side members supporting the slats during tilting of the slats and also during non-tilting. In this manner the slats may be supported by the longitudinal side members in all degrees of orientation including a horizontal position, as would occur when used to cover a skylight, or an inclined position, as would occur when covering an inclined opening. Further, the blind assembly according to the invention may also be used in a vertical arrangement, that is where the longitudinal axes of the slats extend vertically, or in the more conventional horizontal arrangement where the plane of the assembly of slats is vertical and the longitudinal axes of the slats extend horizontally. In the vertical arrangement additional means are preferably included to either connect the slats fixedly to the side members or tape ladders, or to support the lower ends of the slats.

In one form of the invention, the longitudinal side members of each support means are operatively connected together and a resilient means, for example a tension spring, operatively connects the longitudinal side members of one slat support means to the longitudinal side members of another slat support means to impart tension in all the longitudinal members. Following this form of the invention, the longitudinal members of one slat support means may be connected together and extend over a pulley which is connected by a resilient means to a further pulley over which the longitudinal side members of the other slat support means extend.

A further form of the invention involves having ends of two longitudinal side members of one slat support means connected to a bracket in turn connected by a resilient means to a further bracket connected to ends of the two longitudinal side members of the other slat support means.

A still further form of the invention involves having each longitudinal side member of one slat supporting means on one face of the assembly of slats facing towards either the interior or the exterior of an opening and having each longitudinal side member connected by a resilient means to a longitudinal side member of another slat supporting means on the opposite face of the assembly of slats.

In yet another form of the invention, the longitudinal side members of each support means are operatively connected together by a resilient means, and further extend over a respective pulley. Each pulley is connected by link means to a further pulley over which the longitudinal side members of the other slat support means extend. In this manner, as well as in the previously described embodiments, tension is maintained constant in the longitudinal side members during all degrees of tilting of the slats by the slat tilt means.

In a still further form of the invention, the longitudinal side members of two slat supporting means on the same side of a blind assembly are operatively connected together by a resilient means such that alternating tension exists between the longitudinal side members on one side of the blind assembly as opposed to the tension in the longitudinal side members on the other side of the blind assembly, which occurs during tilting of the slats by the slat tilt means. Tension still exists in all members during tilting but tension will vary depending on the degree of tilt.

Preferably the longitudinal side members each comprise a cable forming part of a tape ladder and the means supporting the slats comprise rungs extending between cables spaced apart a slat width. The longitudinal side members could also comprise cables connected directly to the slats.

In all forms of the invention previously described, the slat tilt means are preferably contained within a first headrail adapted to be connected to a fixed frame member and the resilient means in a second headrail adapted to be connected to a further fixed frame member. One of the headrails, preferably but not necessarily the headrail containing the resilient means, is detachably connected to the fixed frame member in order that when disconnected, the headrail and plurality of slats may be moved towards the other headrail to allow cleaning of the skylight or pane covered by the blind assembly. For this purpose a slat moving means similar to a conventional slat lift means connects the two headrails.

In order to prevent the detachable headrail and slats from falling when the detachable headrail is disconnected from its fixed frame member, the slats have support portions on each of their ends adapted to slide on fixed side frame members extending between the fixed end frame members which support portions preferably are in the form of notches in the ends of the slats with a side of the notch sliding on the side frame member extending along the tilt axis of the slat. The detachable headrail also has slide portions adapted to slide on the same fixed side frame members to provide support for the rail when it is detached from its fixed end frame member.

The headrail containing the resilient means also may have a plurality of rollers therein over which the individual longitudinal side members may extend.

DESCRIPTION OF THE PREFERRED MODES

Figure 1:
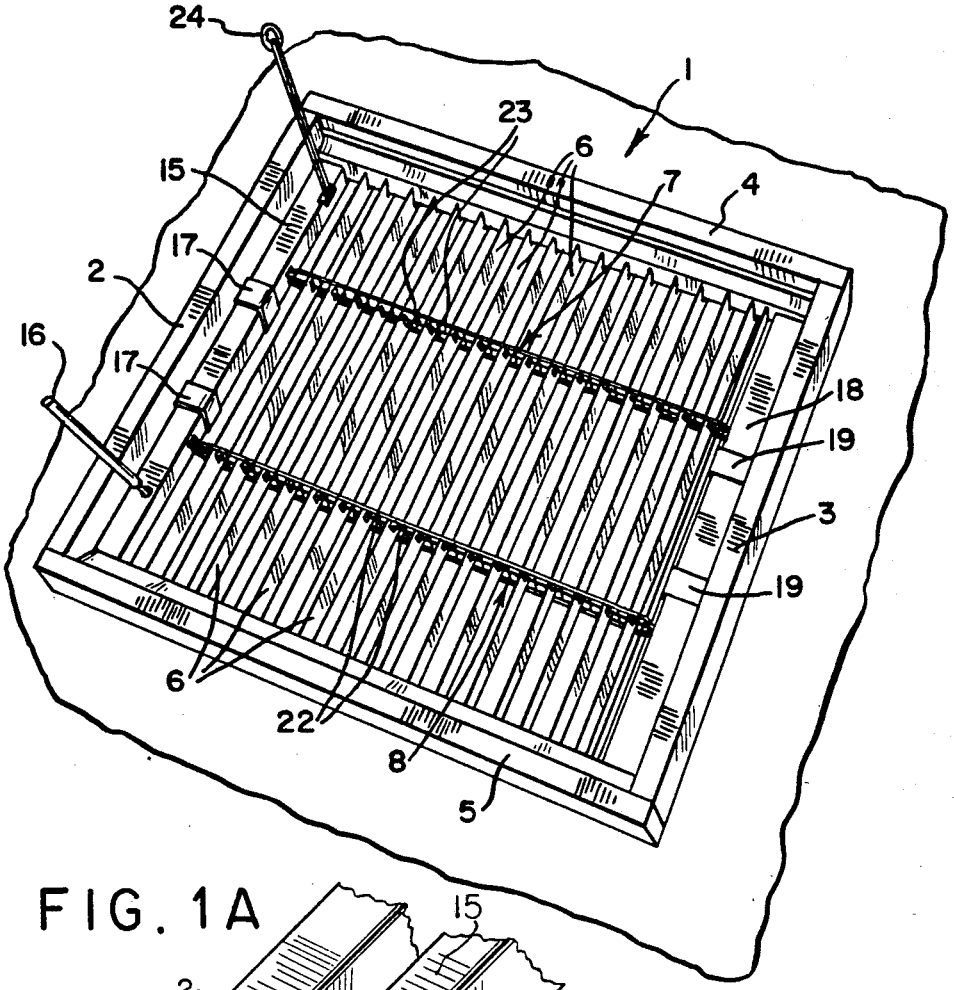
FIG. 1 is a perspective view looking up at a venetian blind assembly constructed according to the invention as applied to a skylight.

Referring to FIG. 1 there is illustrated a venetian blind assembly 1 constructed according to the invention as applied to a skylight opening formed by fixed end frame members 2 and 3 and fixed side frame members 4 and 5. The blind assembly comprises a plurality of individual slats 6 each supported by two slat support means 7 and 8.

Figure 3:
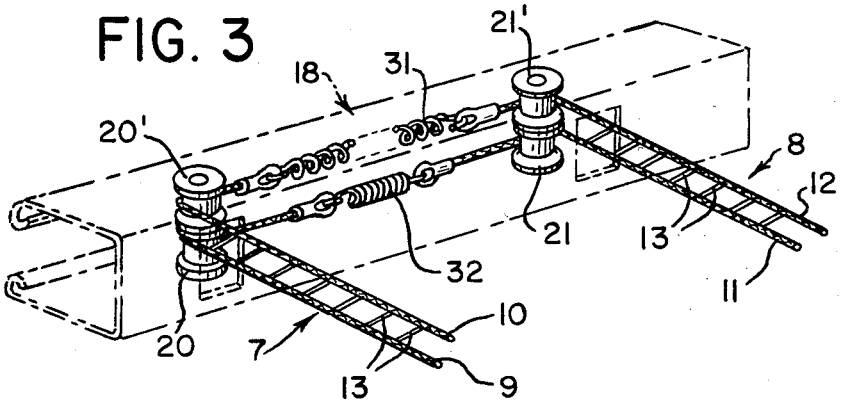
FIG. 3 is an enlarged broken view of a portion of the blind assembly of FIG. 1 illustrating positioning of a resilient tension means in a headrail.

Slat support means 7 as shown in FIG. 3 has two longitudinal side members 9 and 10 while slat support means 8 has two longitudinal side members 11 and 12. The longitudinal side members have means thereon to support the slats, which in the drawings shown, comprise rungs 13 extending between spaced longitudinal side members of the same slat support means and between which a slat is inserted. The slat support means illustrated thus comprises a conventional ladder tape 22, having rungs which serve as support members, and cables, the cables forming longitudinal side members. While a tape ladder is shown as a slat support means, it is to be understood that the longitudinal side members could be connected by clips or other means directly to each slat thus eliminating any need of rungs, such that the clips or other means serve as support members.

Figure 1A:
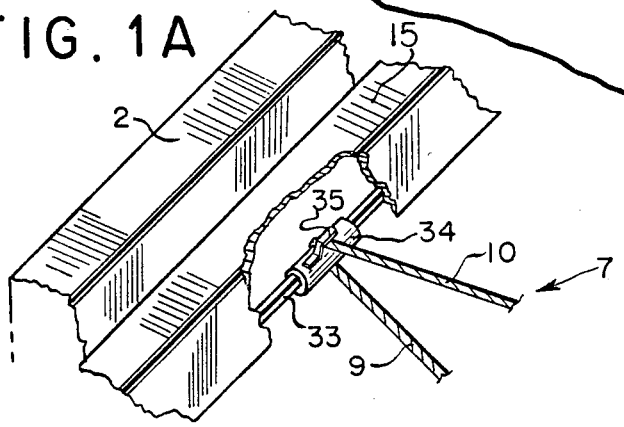
FIG. 1A is an enlarged broken view of a portion of FIG. 1 illustrating a slat tilt means.

The venetian blind assembly as shown in FIGS. 1 and 1A also has a first headrail 15 containing a conventional slat tilt bar 33 operated by a lever 16. An end of each slat support means 7 and 8 is connected to the tilt bar 33. As shown in FIG. 1A, side members 9 and 10 of support means 7 extend over a tilt roll 34 mounted on the tilt bar 33 and are held in place on the roll by a conventional tab 35. Headrail 15 is fixed by way of brackets 17 to the fixed end frame member 2.

A second headrail 18 is detachably connected by brackets 19 to the fixed end frame member 3 and, as shown in FIG. 3, connects with the slat support means 7 and 8 by way of rollers 20, 20', 21 and 21' journalled to the headrail 18 such that the rollers serve as a guide means.

Figure 4:
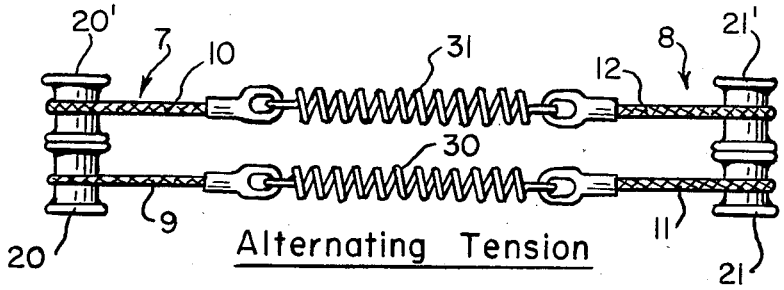
FIG. 4 is a schematic view illustrating connection of resilient tension means between longitudinal side members of two slat support means to impart alternating tension in the members.

As shown in FIGS. 3 and 4, the longitudinal side members 9 and 10 of the slat support means 7 are operatively connected respectively to the longitudinal side members 11 and 12 of the slat support means 8 by resilient tension means in the form of tension springs 30 and 31. The result is that all the longitudinal side members 9, 10, 11 and 12 will be under tension such that they may support the slats 6 regardless of the orientation of the blind assembly, that is, notwithstanding whether the assembly extends horizontally as occurs when used with a skylight, is inclined to a vertical plane, or is in a vertical plane with the slats extending either vertically or horizontally.

In the arrangement of the connection of the longitudinal side members as shown in FIGS. 3 and 4, an alternating tension force will be imparted to the longitudinal side members upon tilting of the slats from the fully open position to a closed position. Thus in FIG. 3, tension in members 10 and 12 which are operatively connected by spring 31 will increase while tension in members 9 and 11 operatively connected by spring 30 will decrease on tilting of the slats by a slat tilt means from a fully open position. The increased tension in the members 10 and 12 will compensate for the decreased tension in members 9 and 11 to provide the necessary support for the slats to prevent their sagging.

Figure 5:
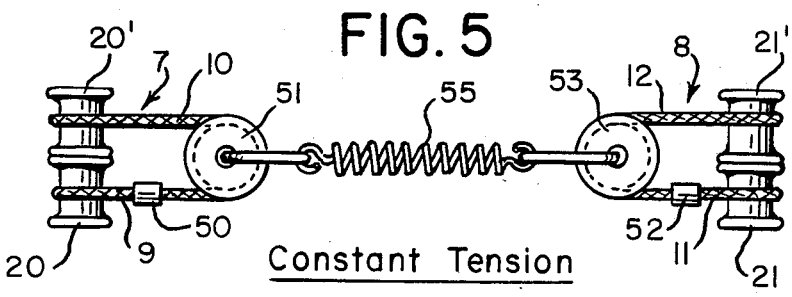
FIG. 5 is a schematic view illustrating connection of resilient tension means between longitudinal side members of two slat support means to impart constant tension in the members.
Figure 6:
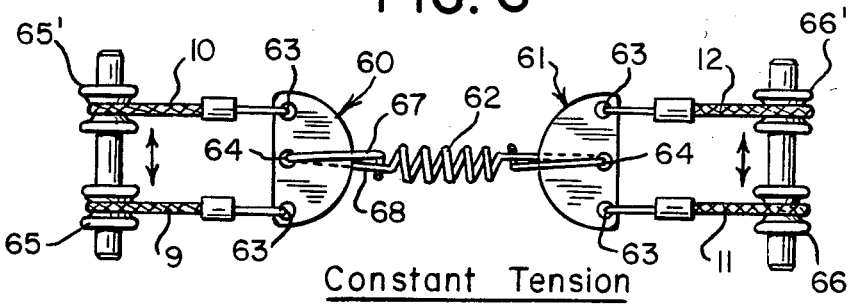
FIG. 6 is a schematic view illustrating a further form of connection of resilient means between longitudinal side members to produce a constant tension in the members.
Figure 7:
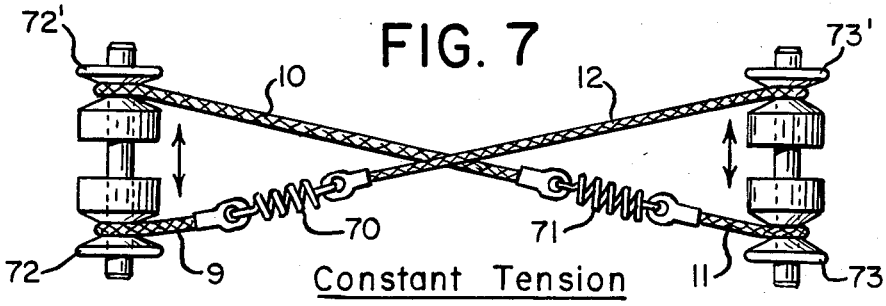
FIG. 7 is a schematic view of a still further form of connection of a resilient means to produce constant tension in longitudinal side members of two slat support means; and, FIG. 8 is a schematic view of a still further form of connection of a resilient means to produce constant tension in longitudinal side members of two slat support means.

Referring to FIGS. 5, 6 and 7 there are shown arrangements for connecting longitudinal side members and resilient means by which the tension in all the longitudinal side members remains constant during tilting of the slats and regardless of the degree of tilting.

In the arrangement of FIG. 5, the longitudinal side members 9 and 10 of the slat support means 7 are joined together by a coupling 50 and extend over a pulley 51 while the longitudinal side members 11 and 12 of the slat support means 8 are joined together by a coupling 52 and extend over a pulley 53. Pulleys 51 and 53 are operatively connected by a resilient means in the form of a tension spring 55 which will impart the same tension in all the members 9, 10, 11 and 12.

In the arrangement of FIG. 6, the members 9 and 10 are operatively joined together by a bracket 60 while members 11 and 12 are operatively joined together by a further bracket 61 where both brackets are semi-circular in shape. A tension spring 62 connects the brackets 60 and 61 so that all the members 9–12 are under the same tension during all degrees of tilting of the slats to provide the force necessary to prevent the slats from sagging. The side members are connected to each bracket at points 63 which are in alignment with point 64 where the spring 62 connects with the bracket which increases the stability of the arrangement, allows for better closure of the slats and reduces excess stress on the side members during extreme tilt positions when the side members of a single slat support means move towards each other. In order to allow the side members of a single support means to move easily towards one another, rollers 65, 65' and 66, 66' over which the side members extend have guide flanges thereon and the rollers of a single support means are mounted for movement axially with respect to each other. In the alternative the rollers 65, 65' and 66, 66' could be fixed against relative axial movement and the distance between the guide flanges of each roller increased to allow the individual side members to slide axially on the surface of the rollers to move towards and away from each other during tilting of the slats as with the embodiments of FIGS. 4 and 5.

The spring 62 has a clip at each end which extends through the point 64 so that arms 67 and 68 of the clip extend below and over a bracket to prevent its turning about the point 64 in a plane other than one containing the axes of the rollers 65, 65' and 66, 66'.

The arrangement shown in FIG. 7 also provides constant tension during all degrees of tilting. Here a longitudinal side member on one face of the blind assembly and of one slat support means is operatively connected by a resilient means to a longitudinal side member of the other slat supporting means on the opposite face of the blind assembly. Thus member 10 of slat supporting means 7 is operatively connected by resilient means 71 to member 11 of slat supporting means 8 while member 9 is operatively connected by resilient means 70 to member 12. As explained previously with reference to FIG. 3, as the slats are tilted from the open position, the longitudinal side members on one face of the blind assembly will tend to be tensioned to a greater degree than the longitudinal side members on the opposite face of the blind assembly depending on the direction of tilt. In the FIG. 7 arrangement, the decrease in tension of members 9 and 11 will be compensated by the increase of tension of members 10 and 12 with the result that the tension will remain constant. As with the embodiment of FIG. 6, the rollers 72, 72' and 73, 73' over which the side members extend are movable axially with respect to each other to accommodate movement of the side members towards and away from each other during tilting of the slats.

Figure 8:
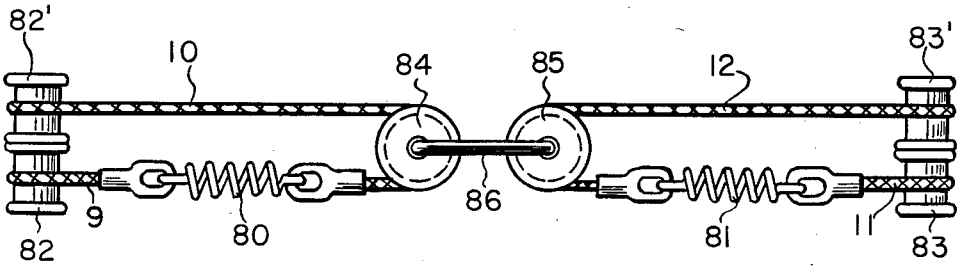

Another arrangement providing constant tension during all degrees of tilting is shown in FIG. 8, wherein members 9 and 10 of slat supporting means 7 are operatively connected together by resilient means 80, and members 11 and 12 of slat supporting means 8 are operatively connected together by resilient means 81. As in previous embodiments, rollers 82, 82' and 83, 83' are provided to support members 9, 10, 11, and 12, respectively. As seen in FIG. 8, portions of members 10 and 12 that extend between their respective rollers and resilient means pass over respective pulleys 84 and 85. These pulleys are connected together at their axes by link means 86.

While the slat support means 7 and 8 are shown connected to the end fixed frame member 3 by way of the headrail 18, they could be connected directly to the frame member by fastening the rollers 20, 20' and 21, 21' to the frame member.

Figure 2A:
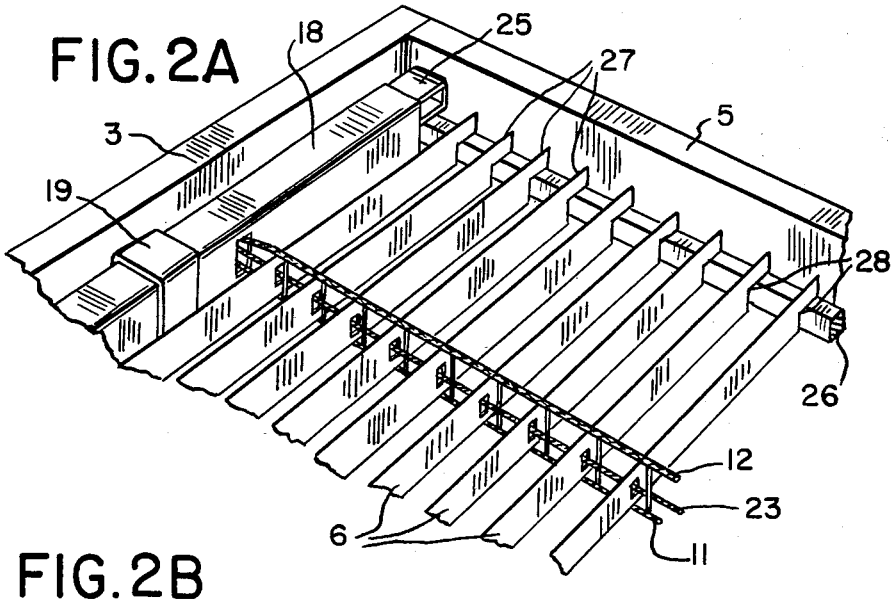
FIG. 2A is a broken view of a portion of the blind assembly of FIG. 1 illustrating the slats in an open position.

The headrail 18 is preferably connected to the headrail 15 by a slat moving means comprising cord 23 shown in FIG. 2A, connected at one end to the headrail 18 by means not shown and connected at the other end to a ring 24 at the headrail 15. Pulling ring 24, when the brackets 19 have been detached from the headrail 18, will move the headrail 18 and slats towards the headrail 15 thus making any cover of the opening formed by the fixed frame members, such as a skylight or glass pane, accessible for cleaning.

Figure 2B:
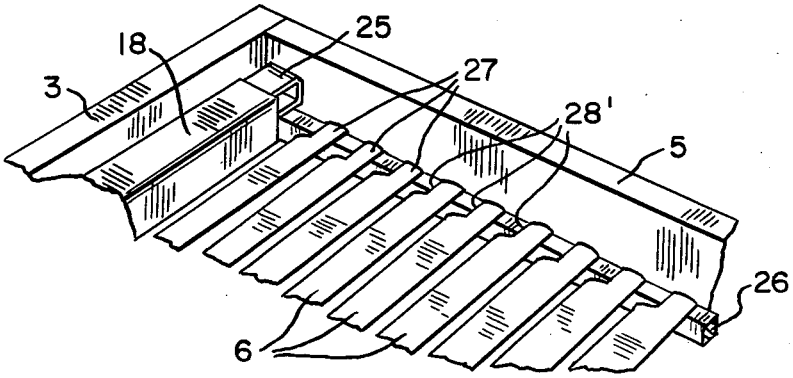
FIG. 2B is a view similar to FIG. 2A illustrating the slats in a closed position.

The headrail 18 may have a slide portion 25 on each end thereof as shown in FIGS. 2A and 2B slidable on a flange 26 forming part of the side fixed frame members in order to support the same when it is detached from the end frame member 3. Further each slat may also have a support portion 27 on each end thereof formed by a notch 28 cut in the slat where an edge 28' of the notch slides upon the flange 26. In order that the flange will not interfere with tilting of the slats, it is important that edge 28 extend along the tilt axis of the slat.

While the slide portion 25 of the headrail 18 and support portion 27 of the slats may provide some support for the slats and headrail 18, the main portion of the weight of the slats and headrail are carried by the slat support means when the headrail is connected to the fixed end frame member 3. The primary purpose of the slide portion 25 and support portion 27 is to prevent sagging of the assembly when it is moved for purposes of cleaning a skylight or pane.

I claim:

1. A venetian blind assembly comprising a plurality of slats wherein the assembly is adapted to be connected at opposite ends extending parallel to the slats to fixed frame members, in which connected position said blind assembly is non-retractable, at least two slat support means for individually tiltably supporting said slats with each slat support means comprising two longitudinal side members and further support members to support said slats on said side members, and slat tilt means connected to one end of each of said slat support means; characterized in having in addition resilient means cooperating, at the other end of said slat support means from said slat tilt means, with the longitudinal side members of said slat support means for imparting tension in at least one of the longitudinal side members of each slat support means in all positions of the slats.

2. A venetian blind assembly according to claim 1 further characterized in that said two longitudinal side members of a single support means are interconnected and in that said resilient means are operatively included in said two longitudinal side members.

3. A venetian blind assembly according to claim 1 further characterized in that said resilient means comprises a tension spring.

4. A venetian blind assembly according to claim 1 further characterized in that the longitudinal side members of each slat support means are operatively connected together at the end of the assembly opposite said slat tilt means and in that a single resilient means operatively connects the longitudinal side members of one slat support means with the longitudinal side members of another slat support means.

5. A venetian blind assembly according to claim 4 further characterized in having in addition a pulley associated with each slat support means and around which at least one longitudinal side member of each of said associated slat support means extends and wherein said resilient means connects the pulleys associated with each slat support means.

6. A venetian blind assembly according to claim 4 further characterized in having in addition a bracket associated with each slat support means and to which an end of each of the longitudinal side members of the associated slat support means is connected and wherein said resilient means connects the brackets associated with said slat supporting means.

7. A venetian blind assembly comprising a plurality of slats wherein the assembly is adapted to be connected at opposite ends extending parallel to the slats to fixed frame members, at least two slat support means for individually tiltably supporting said slats with each slat support means comprising two longitudinal side members and further support members to support said slats on said side members, and slat tilt means connected to one end of said slat support means; characterized in having in addition first and second resilient means for imparting tension in all of the longitudinal side members at least during tilting of the slats; and further characterized in that at least two longitudinal side members on one face of the venetian blind assembly are operatively connected together by said first resilient means, and at least two longitudinal side members on an opposite face of the venetian blind assembly are operatively connected together by said second resilient means.

8. A venetian blind assembly comprising a plurality of slats wherein the assembly is adapted to be connected at opposite ends extending parallel to the slats to fixed frame members, at least two slat support means for individually tiltably supporting said slats with each slat support means comprising two longitudinal side members and further support members to support said slats on said side members, and slat tilt means connected to one end of said slat support means; characterized in having in addition resilient means for imparting tension in all of the longitudinal side members at least during tilting of the slats; and further characterized in that the longitudinal side member of a slat supporting means on one face of the venetian blind assembly is operatively connected to a longitudinal side member of a further slat supporting means on an opposite face of the venetian blind assembly.

9. A venetian blind assembly according to any one of claims 4, 5, 6, 7 or 8 further characterized in that each said longitudinal side member comprises a cable, and in that each of said further support members comprises at least one rung extending between cables.

10. A venetian blind assembly according to claim 1 further characterized in having in addition a first headrail mounting said slat tilt means adapted to be connected to a fixed frame member and a second headrail into which said resilient means are positioned adapted to be connected to a further fixed frame member.

11. A venetian blind assembly according to claim 10 further characterized in that one of said headrails is detachably connected to a fixed frame member and having in addition slat moving means connecting said headrails by which the detachably connected headrail and slats may be moved towards the other headrail on detachment from a fixed frame member.

12. A venetian blind assembly according to claim 11 further characterized in that said headrail detachably connected to a fixed frame member has said resilient means positioned inside thereof.

13. A venetian blind assembly according to claim 10 further characterized in having a plurality of roller means rotatably mounted in the headrail in which said resilient means are positioned and over each of which a longitudinal side member extends.

14. A venetian blind assembly according to claim 1 further characterized in having in addition guide means over which said longitudinal side members extend.

15. A venetian blind assembly according to claim 14 wherein said guide means are adapted to be fixed relative to a fixed frame member.

16. A venetian blind assembly according to claim 1 further characterized in that the two longitudinal side members of each of said slat support means are interconnected and in that said resilient means are operatively interconnected between said two longitudinal side members.

17. A venetian blind assembly comprising a plurality of slats wherein the assembly is adapted to be connected at opposite ends extending parallel to the slats to fixed frame members, in which connected position said blind assembly is non-retractable, at least two slat support means for individually tiltably supporting said slats with each slat support means comprising two longitudinal side members and further support members to support said slats on said side members, and slat tilt means connected to one end of each of said slat support means; characterized in having in addition resilient means cooperating, at the other end of said slat support means from said slat tilt means, with the longitudinal side members of said slat support means for imparting tension in at least one of the longitudinal side members of each slat support means in all positions of the slats, a first headrail mounting said slat tilt means adapted to be connected to a fixed frame member, a second headrail into which said resilient means are positioned adapted to be connected to a further frame member, in that one of said headrails is detachably connected to a fixed frame member, a slat moving means connecting said headrails by which the detachably connected headrail and slats may be moved towards the other headrail on detachment from a fixed frame member, and support portions on the end of said slats adapted to slidably engage fixed side frame members extending between said fixed frame members.

18. A venetian blind assembly according to claim 17 further characterized in that each support portion comprises a notch cut in the end of a slat with one side of the notch extending along the tilt axis of the slat.

19. A venetian blind assembly according to claim 17 further characterized in that said headrail detachably connected to a fixed frame member has slide portions on each end thereof adapted to slidably engage a fixed side frame member.

* * * * *